US007472876B2

(12) United States Patent
Jones

(10) Patent No.: US 7,472,876 B2
(45) Date of Patent: Jan. 6, 2009

(54) BRACKET SYSTEM

(76) Inventor: Thomas M. Jones, 17712 Gothard St., Unit B, Huntington Beach, CA (US) 92647

( * ) Notice: Subject to any disclaimer, the term of this patent is extended or adjusted under 35 U.S.C. 154(b) by 25 days.

(21) Appl. No.: 11/459,155

(22) Filed: Jul. 21, 2006

(65) Prior Publication Data

US 2008/0017777 A1 Jan. 24, 2008

(51) Int. Cl.
*E04G 3/20* (2006.01)

(52) U.S. Cl. ..... 248/242; 108/108; 248/250

(58) Field of Classification Search ..... 248/250, 248/235, 240, 240.1, 240.3, 242, 248, 247; 108/108; 211/88.01
See application file for complete search history.

(56) References Cited

U.S. PATENT DOCUMENTS

| | | | | |
|---|---|---|---|---|
| 350,031 | A | 9/1886 | Bacon | |
| 577,977 | A | 3/1897 | Corscaden | |
| 744,265 | A | 11/1903 | Voight | |
| 967,419 | A | 8/1910 | Neidl | |
| 1,347,116 | A | 7/1920 | Morgan | |
| 2,483,758 | A * | 10/1949 | Douglas | 248/242 |
| 2,900,085 | A | 8/1959 | Levy | |
| 4,334,483 | A | 6/1982 | Kellogg | |
| 4,448,380 | A * | 5/1984 | Huber-Krattiger | 248/235 |
| 4,450,121 | A * | 5/1984 | Bequette | 264/31 |
| 4,804,159 | A | 2/1989 | Martel | |
| 4,880,203 | A * | 11/1989 | Holcomb et al. | 249/24 |
| D343,569 | S | 1/1994 | Jeng | |
| 5,452,875 | A * | 9/1995 | Kern | 248/242 |
| 5,865,410 | A | 2/1999 | Horen | |
| 6,019,331 | A | 2/2000 | Hoogland et al. | |
| 6,913,235 | B2 | 7/2005 | Oberhaus | |
| 2004/0104322 | A1 * | 6/2004 | Hennequin | 248/241 |
| 2004/0211869 | A1 * | 10/2004 | Remmers | 248/235 |
| 2004/0227041 | A1 * | 11/2004 | Lewis | 248/220.41 |

FOREIGN PATENT DOCUMENTS

| | | | |
|---|---|---|---|
| DE | 003504728 | A1 | 4/1986 |
| GB | 2005989 | A * | 5/1979 |

* cited by examiner

*Primary Examiner*—Ramon O Ramirez
(74) *Attorney, Agent, or Firm*—Larry K. Roberts

(57) ABSTRACT

An exemplary embodiment of a bracket system for supporting a shelf or countertop includes first and second separate elongated bracket members, each having a connection end and a distal end. The connection end of the first bracket member is adapted for removable attachment to the connection end of the second bracket member. Each of the first and second elongated bracket members includes fastener members for fixing the first and second bracket members together at the connection ends.

25 Claims, 5 Drawing Sheets

BRACKET SYSTEM

BACKGROUND

The installation of a shelf, cabinet, countertop or other fixture may include attaching a right angle bracket or corbel to a wall surface to support the fixture. This can be a time consuming task. Sometimes a wall cleat is installed, which may interfere with the bracket or corbel location. Often the wall surface is not true or vertical, leading to additional installation effort when attempting to provide a horizontal shelf or counter surface. Mounting a bracket in a vertical orientation can also be a time consuming task as well.

BRIEF DESCRIPTION OF THE DRAWINGS

FIG. 10 is an isometric view of the bracket system embodiment. FIG. 11 is a right side view of the bracket system embodiment.

DETAILED DESCRIPTION

Figure 1:
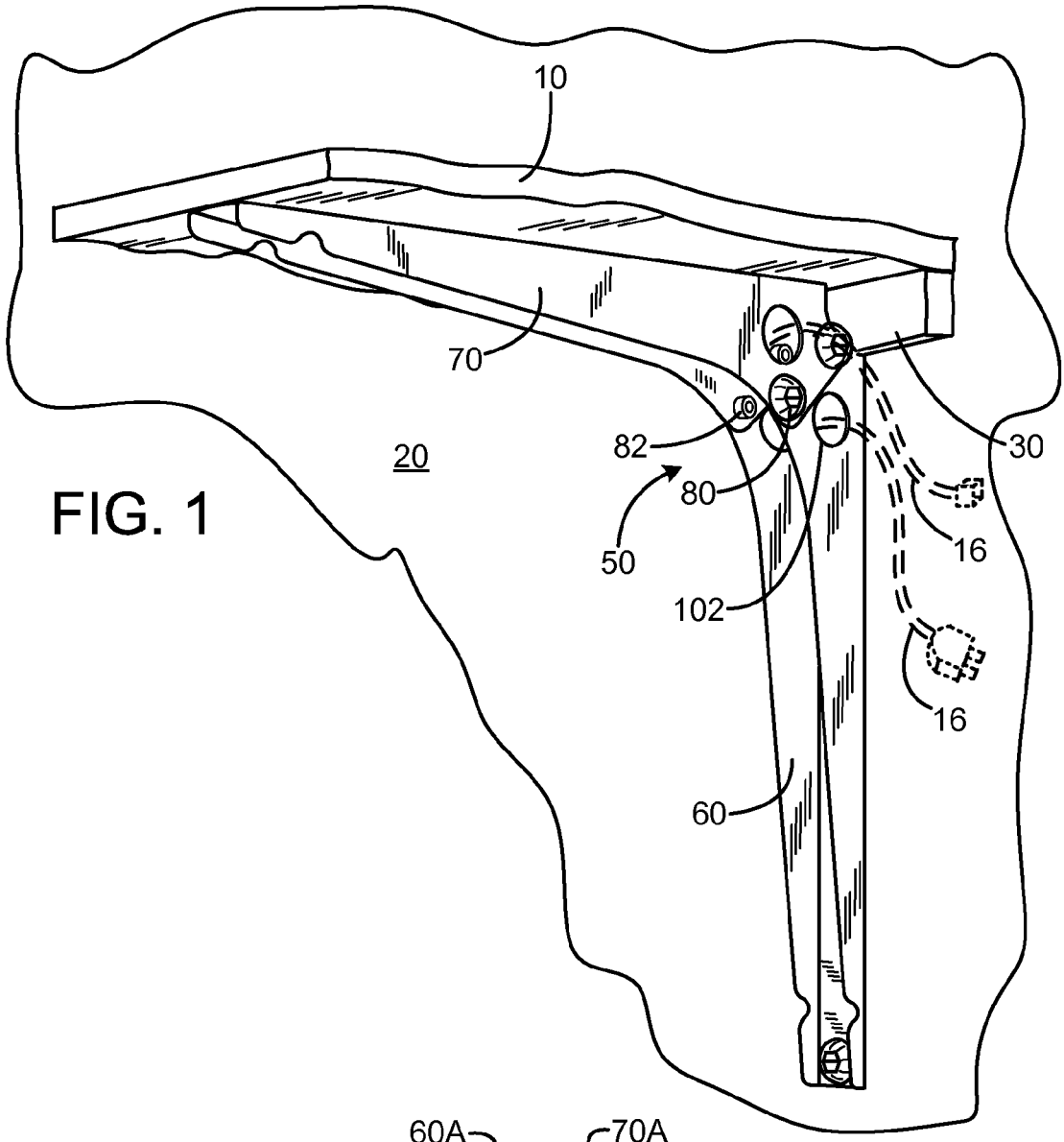
FIG. 1 is an isometric view of an exemplary embodiment of a bracket assembly installed on a wall surface supporting a shelf, countertop or other fixture.

In the following detailed description and in the several figures of the drawing, like elements are identified with like reference numerals. The figures may not be to scale, and relative feature sizes may be exaggerated for illustrative purposes.

An exemplary embodiment of a bracket system 50 is illustrated in FIG. 1. The bracket system 50 is depicted in an installed condition, supporting a shelf 10 on a wall surface 20. In this embodiment, the bracket system 50 comprises two bracket members 60 and 70. In a fully assembled condition, the bracket members are secured together by threaded bolts 80, which pass through respective holes and slots formed in one bracket members to engage nuts 82 attached, e.g. by welding, pressing (as in PIM nuts), brazing or soldering, to inner surfaces of the other bracket member, as will be described more fully below.

Figure 3:
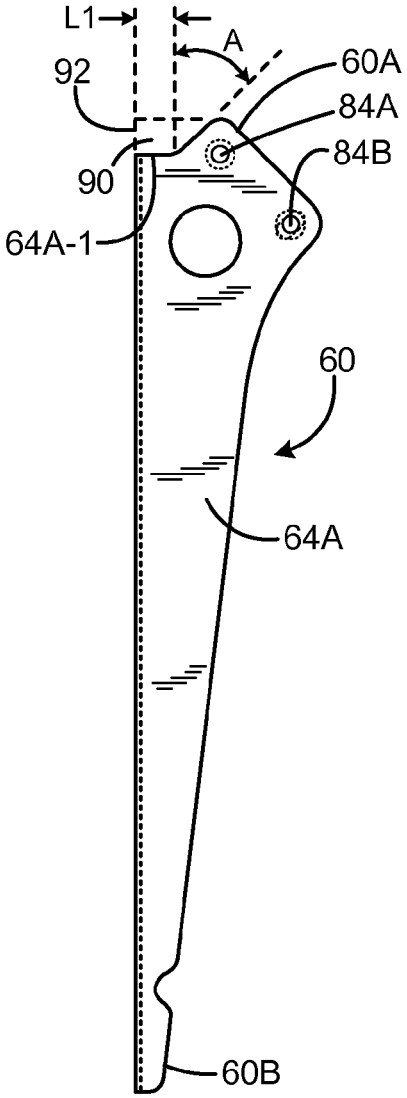
FIG. 3 is left side view of an exemplary embodiment of a bracket member.
Figure 4:
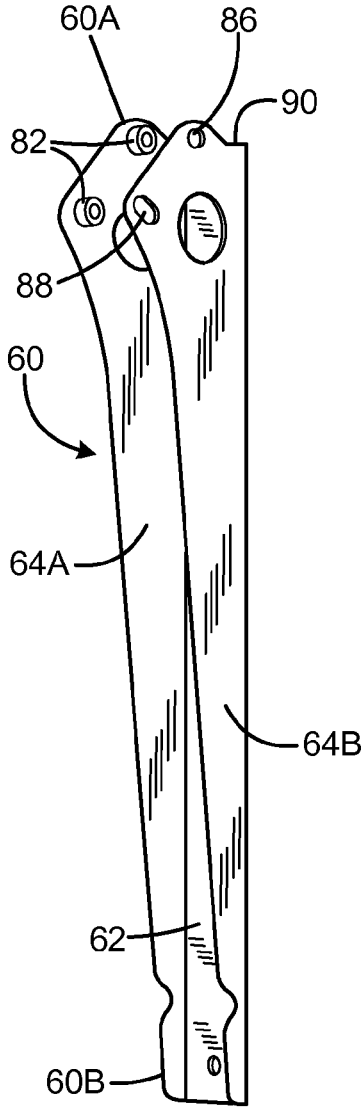
FIG. 4 is an isometric view of the bracket member of FIG. 3.
Figure 5:
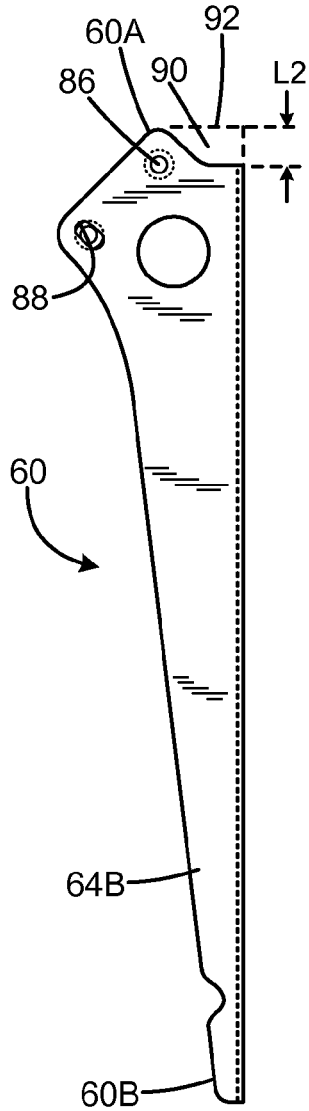
FIG. 5 is a right side view of the bracket member of FIG. 3.
Figure 6:
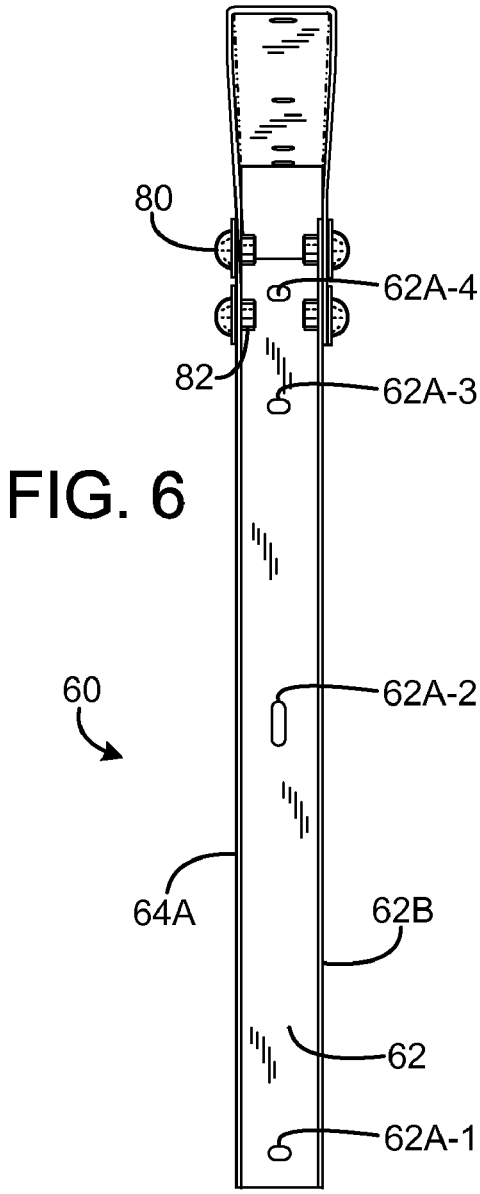
FIG. 6 is a front view of an exemplary embodiment of a bracket assembly.

FIGS. 3-5 further illustrate an exemplary bracket member embodiment, in this case bracket member 60. FIG. 6 illustrates an assembly of bracket members 60 and 70. In an exemplary embodiment, the bracket member 60 has a connection end 60A and a distal end 60B (FIGS. 3-5). The bracket member 60 includes an elongated flat surface portion

62 which connects opposed walls 64A, 64B extending at right angles to the flat surface portion. In an exemplary embodiment, the bracket members may have a generally U-shaped cross-sectional configuration, and a generally tapered lengthwise configuration. The flat surface portion 62 is adapted to fit against a wall surface such as wall surface 20, or against the bottom surface of the shelf or countertop 10. Openings such as openings 62A-1, 62A-2, 62A-3 and 62A-4 are formed in the flat portion, one adjacent each end of the bracket member, and two inner openings 62A-2, 62A-3 intermediate the outer openings. These openings allow mounting fasteners to be passed through to the wall or shelf, to secure the bracket member to the wall or shelf. Of course, there could be fewer openings or more openings than the exemplary number illustrated.

In an exemplary embodiment, the openings 62A-1, 62A-2, 62A-3 and 62A-4 are slots having a longer dimension in one direction than in the transverse direction. For example, one implementation for an 18 inch long bracket member may have slots which are ¼ inch wide and 7/16 inch long, although the particular dimensions may vary depending on the particular bracket dimensions. Assume for example that the bracket member 60 is to be attached to a wall surface, for example, by screws or lag bolts which are passed through the slots into a wall surface, perhaps to a stud or wall board. The use of slots allows the vertical and horizontal orientations of the bracket member to be adjusted within the range permitted by the slot dimensions. The bracket may, for example, be positioned on the wall surface, and a screw passed through slot 62A-2. The vertical position of the bracket may be adjusted within the range of the slot, and the bracket may be rotated about this screw. A screw may be passed through slots 62A-1 and 62A-3, but since their longitudinal extent is transverse to that of slot 62A-2, the bracket may be shifted within the boundaries of the slots. The installer may use a level or laser indicator to achieve an indicated vertical position of the bracket. The screws may then be tightened down to secure the bracket member 60 in position relative to the wall.

Figure 2:
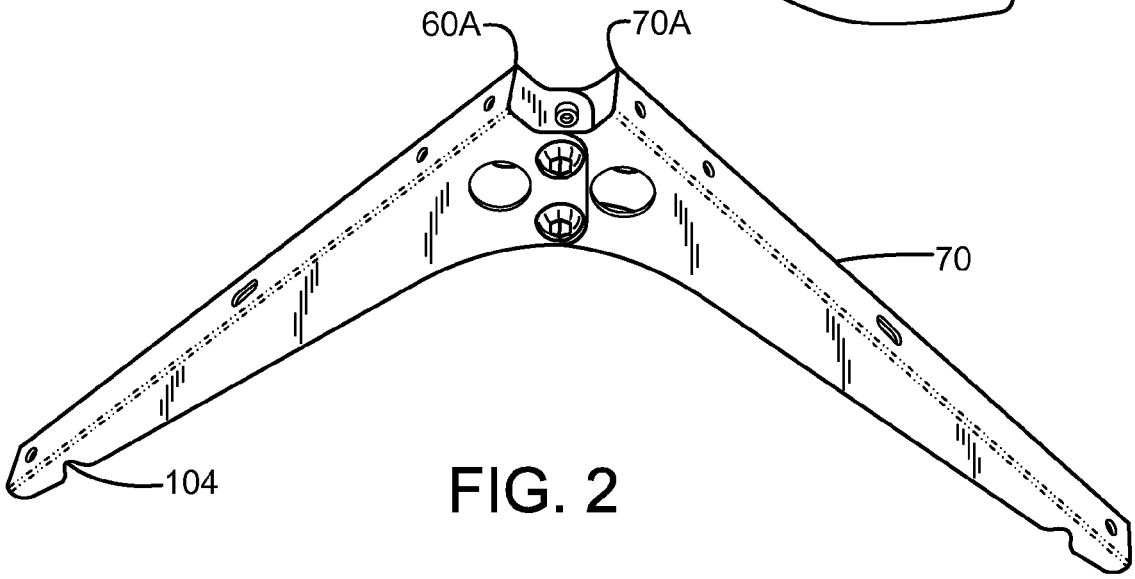
FIG. 2 is an isometric view of an exemplary embodiment of a bracket assembly.

Each of the bracket members 60, 70 has two threaded nut members 82 fastened to an interior surface of one wall, e.g. for member 60, to wall 64A. The nut members are in alignment with holes 84A, 84B formed in the wall portion 64A to allow threaded fasteners 80 (FIGS. 1-2) to pass through the wall to be received in and threadingly engaged by the nut members 82. In one exemplary embodiment, the openings are sized for 5/16 inch bolts as fasteners 80, e.g. corrugated flange bolts or Stover hex bolts, but the particular opening dimension and fastener dimensions may vary depending on the application requirements. The opposed wall portion 64B also has fastener openings 86, 88 (FIG. 4) formed there through. In an exemplary embodiment, the opening 86 is adjacent an end of the bracket member, and will serve as a pivot point when the bracket members 60, 70 are assembled together. In an exemplary embodiment, the opening 88 is a slotted opening, with a longitudinal extent positioned to allow some pivoting movement about the pivot point of opening 86, as described below. In another embodiment, the opening 88 may be a circular opening.

Figure 8:
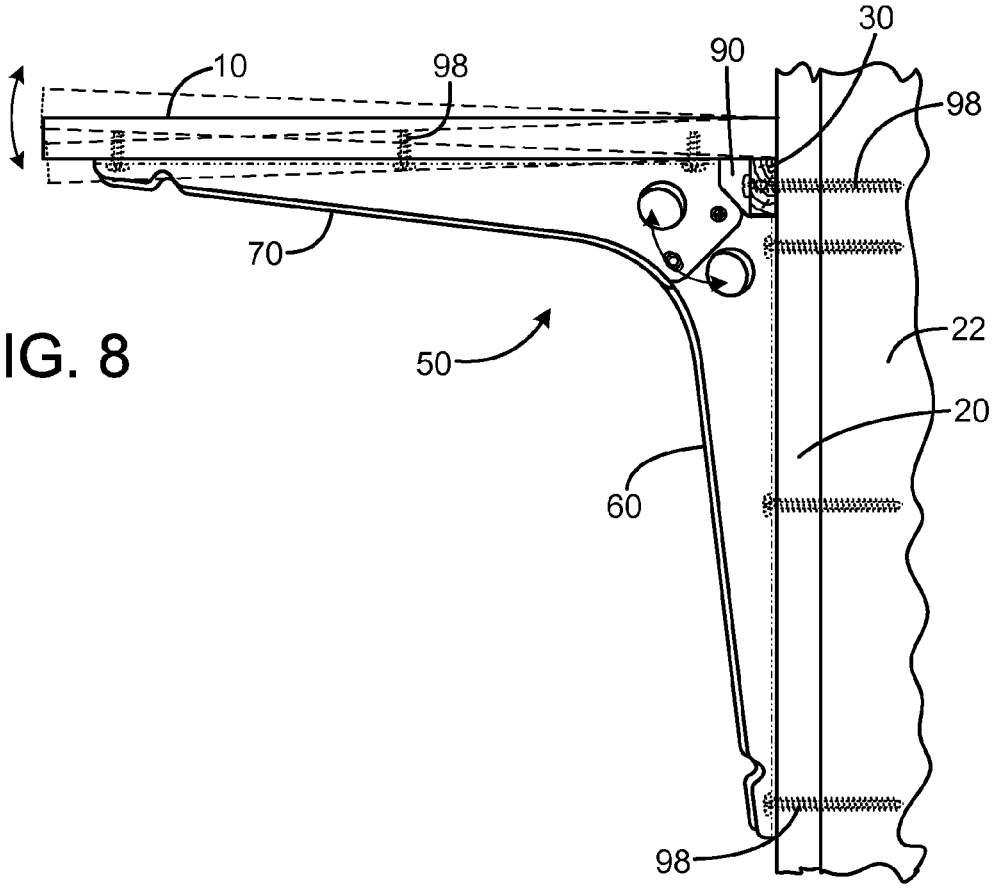
FIG. 8 is a cross-sectional view of an exemplary embodiment of a bracket assembly mounted to a wall in abutment with a rectangular cleat.

In an exemplary embodiment, the bracket members 60, 70 may be identical, although in other embodiments, there may be differences between the two bracket members. The two bracket members may be assembled together, in the configuration illustrated in FIG. 2, for example, with the connection ends 60A and 70A brought into alignment, so that the openings 86 and 88 in one bracket side wall (say of bracket member 60) align with openings 84A, 84B formed in a bracket side wall of the other bracket member (say member 70). Four threaded fasteners 80 may be passed through the holes 84A, 84B, 86, 88 formed in each of the bracket members and into engagement with the corresponding threaded nuts 82 attached to the inner wall surfaces of the respective bracket members. Until the threaded fasteners are tightened, some pivotal movement of the bracket members about the pivot points established by the holes 86, 84A is permitted, e.g. as depicted in FIG. 8, allowing the user to determine the relative angular position of the bracket members. This allows for some adjustment for walls which are out of plumb, and other installation difficulties. In other embodiments, the slotted openings may be replaced with circular holes.

Each side wall portion of a bracket member may have an opening 102 formed therein adjacent the connection end, to allow electrical cabling or wires 16 (FIG. 1) to be passed there through, and to be supported by the bracket member.

Figure 7:
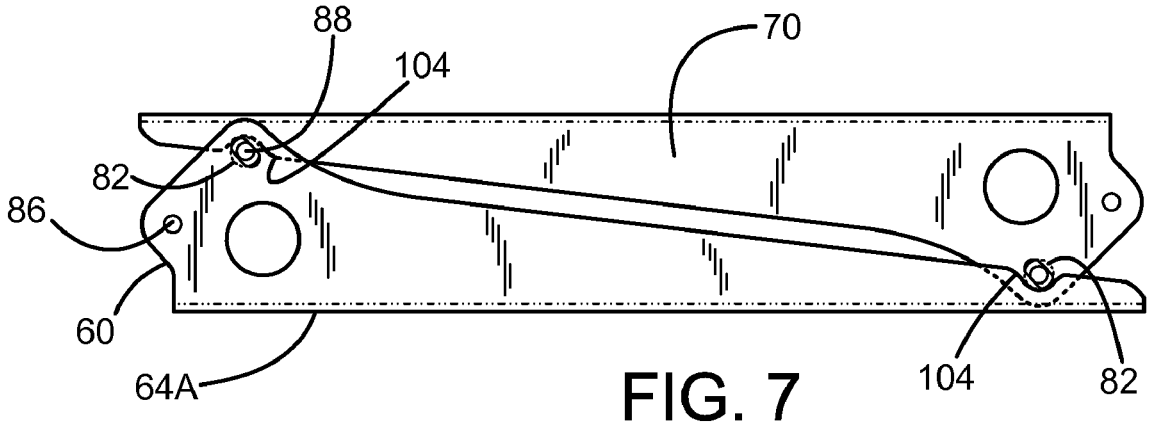
FIG. 7 is a side view of an exemplary embodiment of elements of a bracket assembly in disassembled form, nested together in an arrangement for shipping or storage.

In an exemplary embodiment, the bracket members 60, 70 may be identical to each other to simplify inventory and installation. Moreover, the bracket members 60, 70 in an exemplary embodiment may be nested together as depicted in FIG. 7 for conserving space, e.g. for shipping and storage. In one exemplary embodiment, each bracket member may have a generally tapered configuration from the connection end to the distal end. A relieved area 104 may be formed adjacent the distal end, at a distance from the connection end which accommodates nesting of the fastener nut 82 of a second bracket assembly.

In one exemplary embodiment, the bracket members may be adapted to provide a recess for a shelf cleat. Referring to FIGS. 3-5, the side walls at the connection end of the exemplary bracket member may be formed to define a relieved area such as area 90 depicted within phantom line 92. The relieved area is sized such that, with two bracket members assembled together, a shelf cleat may be accommodated within the relieved area or areas. In an exemplary embodiment, the relieved area has a size of L1 by L2 (FIGS. 3 and 5); in one embodiment, L1=L2, with an exemplary dimension of ¾ inch, although the particular size may vary with the particular application. The relieved area may be further enlarged, by the side wall portion having an angle A, which may be about 45 degrees in one embodiment, departing from a transverse edge (such as edge 64A-1, FIG. 3) of the relieved portion.

Figure 9:
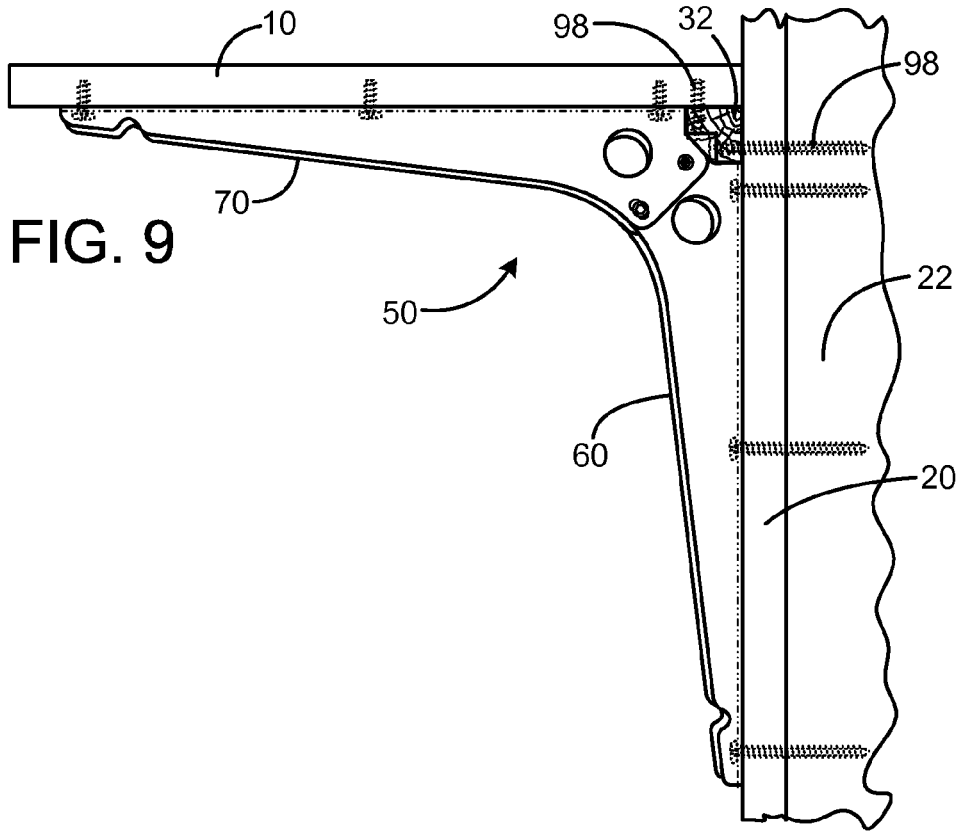
FIG. 9 is a cross-sectional view of an exemplary embodiment of a bracket assembly mounted to a wall in abutment with an L-shaped cleat.

FIGS. 8 and 9 are side view diagrammatic illustrations, showing exemplary bracket system installations with two types of shelf cleats 30, 32. FIG. 8 shows a typical rectangular shelf cleat 30, which may have a ¾ inch by 1½ inch cleat dimension, in which the cleat is secured along a horizontal line by screws 98 which secure the cleat to the wall 20 and wall stud 22. FIG. 9 shows an L-shaped cleat 32, which may be secured to the wall 20 and stud 22 by screws, and also to the shelf 10 by screws. Both types of cleats may be accommodated within the relieved areas of the connection ends of the respective bracket members 60, 70.

A bracket system may facilitate the installation process for shelves, cabinets, countertops and other fixtures. An exemplary installation sequence may generally include the following steps.

1. Install cleat along a horizontal line on a wall. The wall studs may be located during the cleat installation.

2. Install one bracket member (e.g. 60 or 70) to the wall. This step may include positioning the transverse edge (e.g. 64A-1) against the bottom surface of the cleat, using a level or laser sight to position the bracket member vertically, installing screw fasteners through slots in the flat portion of the bracket member into the wall, without tightening the fasteners, confirming the vertical orientation by shifting/rotating the bracket member within movement limits established by the slot dimensions until the desired vertical orientation is achieved, and then tightening the screw fasteners to secure the bracket member against the wall and the cleat.

3. Optionally repeating step 2 along a horizontal extent of the shelf cleat for additional bracket systems to support the fixture. Typically more than one bracket assembly may be used to support a fixture, and perhaps more, each at a wall stud, depending on the load presented by the fixture.

4. Loosely attach the second bracket member to the vertically installed bracket member, by use of screw fasteners 80 and nuts 82. Pivot the second bracket member to a desired horizontal position, within the range of movement permitted by slot 88 about pivot holes 84A, 86, and tighten the screw fasteners 80 to a tightened position.

5. Position the fixture on the second bracket member, and install screw fasteners.

6. Optionally, after positioning or installing the fixture on the second bracket member, the horizontal position of the second bracket member may be adjusted to ensure that the fixture surface such a shelf or countertop is level or to meet other installation parameters.

The bracket system may be employed to mount shelves, countertops, cabinets and other fixtures to various types of walls and wall surfaces, e.g. tiled walls, concrete block walls, poured concrete walls, drywall with wood or metal studs, and wood, by way of example only.

The bracket system may also be used without a wall cleat. In this case, the installation process is similar to that described above, except that the installer positions the bracket member on the wall at the desired location(s), typically using a measuring tape, level and the like.

The bracket members of the bracket assembly may be fabricated of many different materials. In exemplary embodiments, the bracket members are fabricated of metal, e.g., stainless steel or powder coated steel. An exemplary fabrication process may include stamping the bracket member from a sheet of metal, and further processing through a bender machine to bend the side wall portions in 90 degree angles relative to the flat portion. The thickness of the metal sheet may vary depending on the particular application and load requirements. An exemplary thickness range may be from 10 gauge to 16 gauge, although the thickness may depend on the load requirements and other factors.

The bracket members of the bracket system may be fabricated in different scales and lengths, to accommodate a variety of installation conditions and customer applications. Exemplary lengths for the bracket members include 6, 8, 12, 16, 18, 22 and 27 inch lengths. The lengths may also be selected in accordance with a given shelf, countertop or cabinet depth dimension, with the bracket member length somewhat shorter than this fixture depth dimension for clearance.

For some embodiments of a bracket assembly system, the bracket members may not be identical, The bracket members may even be of different length in some embodiments. For example, the respective bracket members of a particular bracket system may have lengths of 27 inches and 22 inches, or 22 inches and 18 inches, or 16 inches and 12 inches. Other length combinations may also be provided.

Figure 10:
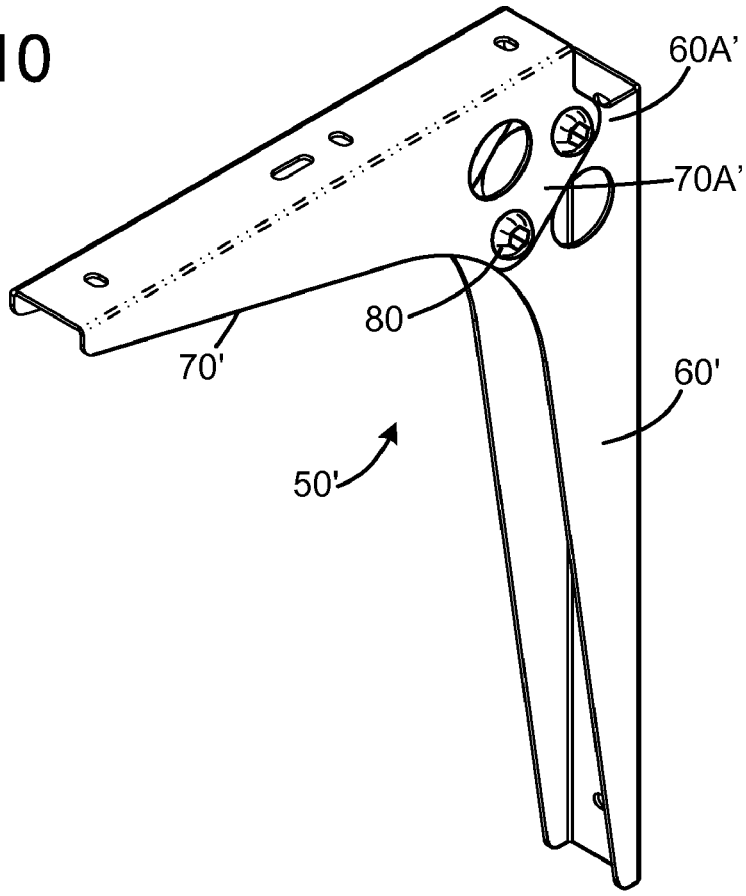
FIGS. 10 and 11 illustrate an exemplary embodiment of a bracket system in which the bracket members are of different lengths.
Figure 11:
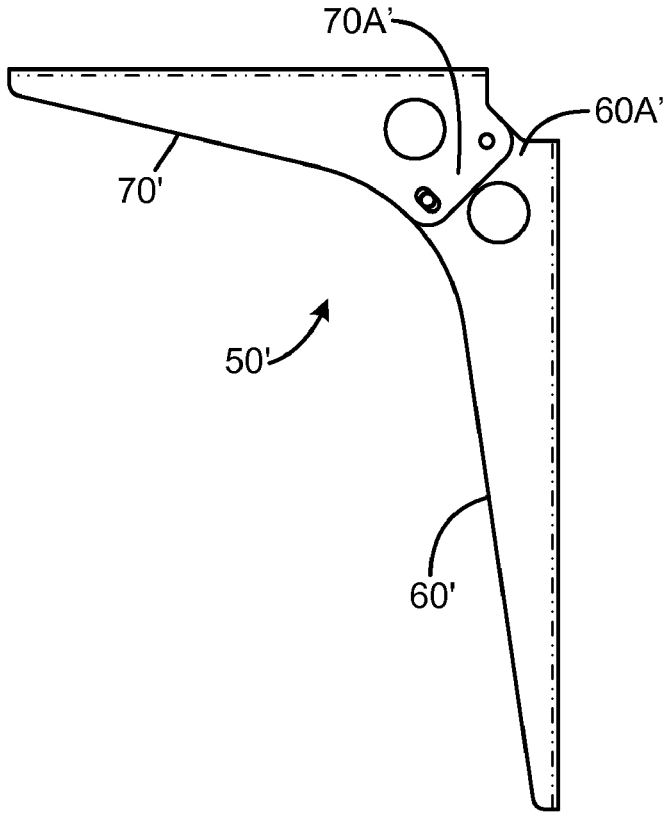

FIGS. 10 and 11 illustrate an exemplary embodiment of a bracket system 50' in which the bracket members 60', 70' are of different lengths. In an exemplary embodiment, the bracket member to be fitted against the wall surface, 60' for example, may be longer than the bracket member attached to the shelf, cabinet, countertop or other fixture, say 70'. The connection ends 60A' and 70A' are still adapted for connection together in the same manner as described above for the embodiments of FIGS. 1-8, using fasteners 80 and nuts.

Although the foregoing has been a description and illustration of specific embodiments, various modifications and changes thereto can be made by persons skilled in the art without departing from the scope and spirit of the invention as defined by the following claims.

What is claimed is:

1. A bracket assembly for supporting a shelf, countertop, cabinet or other fixture, comprising:

first and second elongated bracket members, the first bracket member having a first end adapted for attachment to a first end of the second bracket member;

wherein said first and second bracket members are adapted for pivotal movement about a pivot axis through a range of movement when said first ends are attached at a pivot point by a first set of fastener members;

a second set of fastener members adapted to fix the first and second bracket members together at any position within said range of movement to allow for adjustment for out of plumb walls, said second set of fasteners including a male threaded member passed through respective openings defined in said first and second bracket members at spaced locations from said pivot axis and configured to threadingly engage a threaded receptacle to fix the first and second bracket members together, the respective openings including a slotted opening configured to define the range of motion.

2. The bracket assembly of claim 1, wherein said first and second elongated bracket members include identical elongated structural members.

3. The bracket assembly of claim 1, wherein said first bracket member includes an elongated flat portion for positioning against a flat surface, and a plurality of openings formed in the flat portion for passage of a fastener member.

4. The bracket assembly of claim 3, wherein the plurality of openings formed in the flat portion include a first slot opening and a second slot opening, the first slot opening having a longitudinal extent which is transverse to a longitudinal extent of the second slot opening.

5. The bracket assembly of claim 3, wherein said first bracket member further includes opposed wall members joined by said elongated flat portion, the wall member extending transverse to a plane of said flat portion.

6. The bracket assembly of claim 1, wherein the first and second bracket members are fabricated of steel.

7. The bracket assembly of claim 1, further comprising openings formed in each of the elongated bracket members adjacent said first ends to allow passage of cabling and electrical cords.

8. The bracket assembly of claim 1, wherein the first and second elongated bracket members have respective first and second length dimensions which are different from each other.

9. A bracket assembly for supporting a shelf, countertop, cabinet or other fixture, comprising:

first and second elongated bracket members, the first bracket member having a first end adapted for attachment to a first end of the second bracket member;

wherein said first and second bracket members are adapted for pivotal movement about a pivot axis through a range of movement when said first ends are attached at a pivot point by a first set of fastener members;

each of said first and second elongated bracket members including a second set of fastener members for fixing the first and second bracket members together at a pivot position within said range of movement; and wherein the first end of each of said first and second bracket members includes a relieved cleat area to allow close positioning of a cleat member adjacent the first ends when the bracket assembly is in an installed condition.

10. A bracket system, comprising: first and second separate elongated bracket members, each having a connection end and a distal end and a generally U-shaped cross-sectional configuration, the connection ends of the first bracket member adapted for removable attachment to the connection end of the second bracket member;

each of said first and second elongated bracket members including fastener members for removably attaching the first and second bracket members together at said connection ends; and wherein the connection end of each of said first and second bracket members includes a relieved cleat area to allow close positioning of a cleat member adjacent the connection ends when the bracket assembly is in an installed condition.

11. The system of claim 10, further comprising openings formed in each of the elongated bracket members adjacent said connection ends to allow passage of cabling and electrical cords.

12. A bracket system, comprising:

first and second separate elongated bracket members, each having a connection end and a distal end and a generally U-shaped cross-sectional configuration, the connection end of the first bracket member adapted for attachment to the connection end of the second bracket member;

each of said first and second elongated bracket members including fastener members for connecting the first and second bracket members together at said connection ends, said fastener members permitting pivoting movement of the first and second bracket members through an angular range of motion when in a first condition, and fixing the position of the first and second bracket members at any angular position within said range of movement when in a second condition; and wherein said fastener members include at least one threaded nut attached to said first bracket member to receive a threaded fastener member therein, said fastener members including a first set of threaded fasteners passed through a first set of openings in the first and second bracket members defining a pivot axis and a second set of fastener threaded fasteners passed through a second set of openings in the first and second bracket members spaced from the first set of openings, the second set of openings including slotted openings defining the angular range of motion.

13. The bracket assembly of claim 12, wherein the first and second bracket members are fabricated of steel.

14. A method for installing a bracket system, comprising a sequence of the following steps:

a. installing a cleat horizontally on a wall;

b. vertically installing a first bracket member to the wall, including positioning a transverse edge of the first bracket member in a relieved cleat area of the first bracket member against a bottom surface of the cleat;

c. attaching a second bracket member to the vertically installed first bracket member at a pivot point, the second bracket member having a relieved cleat area;

d. pivoting the second bracket member to any desired horizontal angular position relative to the first bracket member within a range of movement about said pivot point with at least part of the cleat positioned in the relieved cleat area of the second bracket and fixing the second bracket member to the first bracket member at said desired angular position.

15. The method of claim 14, further comprising:

installing a fixture on the second bracket member.

16. The method of claim 14, wherein said vertically installing the first bracket member comprises:

using a level or laser sight to position the bracket member vertically;

installing screw fasteners through slots in a flat portion of the bracket member into the wall without tightening the fasteners, confirming the vertical orientation by shifting/rotating the bracket member within movement limits established by slot dimensions until a desired vertical orientation is achieved, and then tightening the screw fasteners to secure the bracket member against the wall.

17. A bracket system, comprising:

first and second separate elongated bracket members, each having a connection end and a distal end, the connection ends of the first bracket member adapted for removable attachment to the connection end of the second bracket member, each of said first and second bracket members including an elongated flat portion for positioning against a flat surface, and a plurality of openings formed in the flat portion each for passage of a fastener member, and opposed first and second wall portions joined by said elongated flat portion, the first and second wall portions extending transverse to a plane of said flat portion;

bracket fastener members for removably attaching the first and second bracket members together at said connection ends, said bracket fastener members permitting pivoting movement of the first and second bracket members through an angular range of motion when in a first condition, and fixing the position of the first and second bracket members at any angular position within said range of movement when in a second condition;

said bracket fastener members including a first set of threaded fasteners passed through a first set of openings in the first and second bracket members defining a pivot axis and a second set of fastener threaded fasteners passed through a second set of openings in the first and second bracket members spaced from the first set of openings, the second set of openings including slotted openings defining the angular range of motion.

18. The bracket assembly of claim 17, wherein the bracket fastener members further includes a threaded nut attached to said second bracket member to receive said fastener.

19. A bracket system, comprising:

first and second separate elongated bracket members, each having a connection end and a distal end and a generally U-shaped cross-sectional configuration, wherein each of said first and second bracket members includes opposed first and second wall portions joined by an elongated flat portion, the first and second wall portions extending transverse to a plane of said flat portion, the connection end of the first bracket member adapted for removable attachment to the connection end of the second bracket member;

each of said first and second wall portions having defined therein at or adjacent said connection end a pivot hole and an opening spaced from said pivot hole, and wherein at least one of the openings in said first and second wall portions defines a slot opening;

a plurality of fasteners for attaching the first and second bracket members together at said connection ends, said plurality of fasteners permitting pivoting movement of the first and second bracket members about a pivot axis defined by the pivot holes through an angular range of motion determined by the slot openings when in a first condition, and fixing the position of the first and second bracket members at any angular position within said range of movement when in a second condition;

the plurality of fasteners including:

a first threaded member and a first threaded receptacle, the first threaded member configured to pass through the aligned pivot holes in adjacent first walls of the first and second bracket members and be engaged in the first threaded receptacle;

a second threaded member and a second threaded receptacle, the first threaded member configured to pass through the aligned pivot holes in adjacent second walls of the first and second bracket members and be engaged in the second threaded receptacle;

a third threaded member and a third threaded receptacle, the third threaded member configured to pass through the aligned openings in adjacent first walls of the first and second bracket members and be engaged in the third threaded receptacle;

a fourth threaded member and a fourth threaded receptacle, the fourth threaded member configured to pass through the aligned openings in adjacent second walls of the first and second bracket members and be engaged in the fourth threaded receptacle, whereby in said second condition said threaded members are threaded into said receptacles to fix the position of the first bracket member relative to the second bracket member.

20. The system of claim 19, wherein said first bracket member is identical to said second bracket member.

21. The system of claim 19, wherein said first bracket member has a length dimension different than a corresponding length dimension of the second bracket member.

22. The system of claim 19, wherein each of the first and second elongated bracket members have a tapered configuration from said connection end to said distal end.

23. The system of claim 19, wherein each elongated flat portion of said bracket members is configured for positioning against a flat surface, and includes one or more openings formed in the flat portion each for passage of a fastener member.

24. The system of claim 23, wherein the plurality of openings include a first slot opening and a second slot opening, the first slot opening having a longitudinal extent which is transverse to a longitudinal extent of the second slot opening.

25. The system of claim 19, wherein the first, second, third and fourth threaded receptacles are attached to surfaces of a corresponding one of the wall portions of the first and second bracket members.

* * * * *